US006385424B1

(12) United States Patent
Lee et al.

(10) Patent No.: US 6,385,424 B1
(45) Date of Patent: May 7, 2002

(54) ELECTROPHOTOGRAPHIC PRINTING APPARATUS AND IMAGE TRANSFERRING METHOD FOR AN ELECTROPHOTOGRAPHIC PRINTING APPARATUS

(75) Inventors: Won-hyung Lee, Seoul; Kyu-cheol Shin, Kwacheon; Hyung-jin Ahn, Paldal-gu Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/666,805

(22) Filed: Sep. 21, 2000

(30) Foreign Application Priority Data

Sep. 21, 1999 (KR) ..... 99-40669

(51) Int. Cl.[7] ..... G03G 15/16; G03G 15/10

(52) U.S. Cl. ..... 399/297; 399/237; 399/324; 430/126

(58) Field of Search ..... 399/237, 251, 399/297, 307, 324, 325; 118/621, 255, 261, DIG. 1; 430/117, 126

(56) References Cited

U.S. PATENT DOCUMENTS 5,937,248 A * 8/1999 Liu et al. ..... 399/237
5,995,787 A * 11/1999 Takeda et al. ..... 399/237
6,118,966 A * 9/2000 Deishi et al. ..... 399/237
6,186,066 B1 * 2/2001 Kim ..... 399/297 X

* cited by examiner

*Primary Examiner*—Sophia S. Chen
(74) *Attorney, Agent, or Firm*—Robert E. Bushnell, Esq.

(57) ABSTRACT

An electrophotographic printing apparatus having a structure so that differences between surface energies of components of the electrophotographic printing apparatus contributing to image transfer are maintained within predetermined ranges, and an image transferring method thereof. The electrophotographic printing apparatus includes a photosensitive medium, developing units, a drying roller and a transfer unit having a transfer roller, whereby the peeling force ($PF_D$) of the drying roller is in a range of 0 gram force per inch (gf/inch)$\leqq PF_D \leqq$300 gram force per inch (gf/inch), the peeling force ($PF_O$) of the photosensitive medium is in a range of 0 gram force per inch (gf/inch)$\leqq PF_O \leqq$80 gram force per inch (gf/inch), and the peeling force ($PF_T$) of the transfer roller is in a range of 200 gram force per inch (gf/inch)$\leqq PF_T \leqq$500 gram force per inch (gf/inch), respectively, when the peeling forces are measured. The image transferring method for an electrophotographic printing apparatus includes the steps of adjusting the peeling force ($PF_D$) of the drying roller, the peeling force ($PF_O$) of the photosensitive medium, and the peeling force ($PF_T$) of the transfer roller to be within the above mentioned respective ranges.

21 Claims, 6 Drawing Sheets

FIG.7
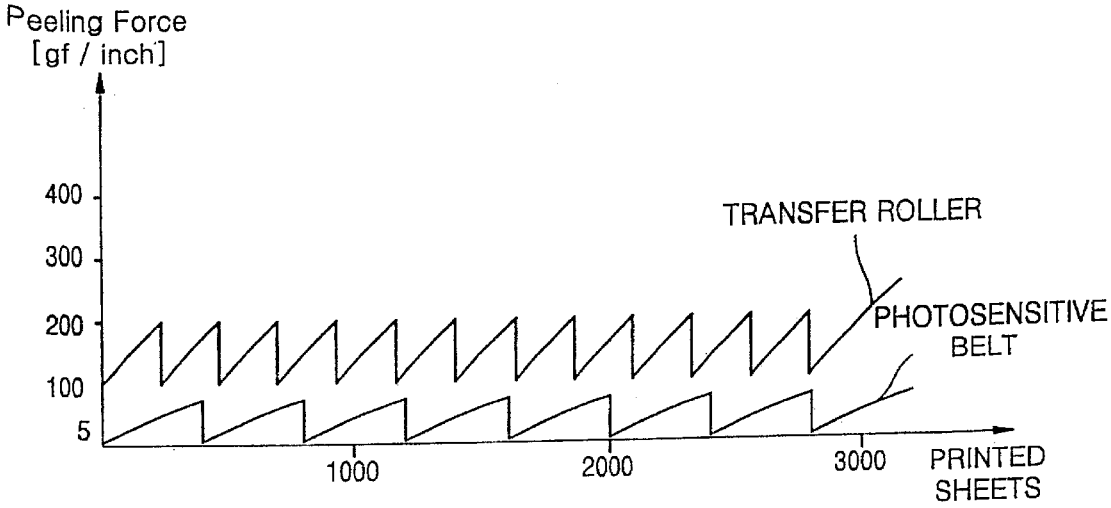
FIG.8A
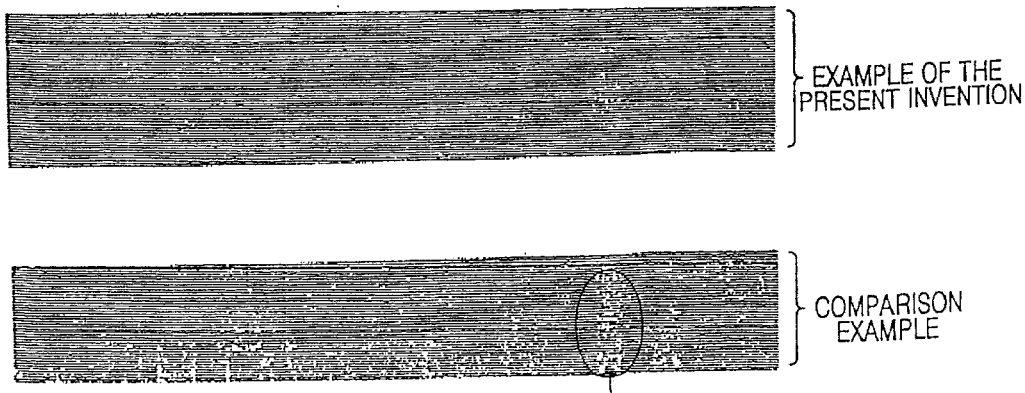
FIG.8B

ELECTROPHOTOGRAPHIC PRINTING APPARATUS AND IMAGE TRANSFERRING METHOD FOR AN ELECTROPHOTOGRAPHIC PRINTING APPARATUS

CLAIM OF PRIORITY

This application makes reference to, incorporates the same herein, and claims all benefits accruing under 35 U.S.C. § 119 from an application entitled ELECTROPHOTOGRAPHIC IMAGING SYSTEM AND METHOD TRANSFERRING IMAGE THEREOF earlier filed in the Korean Industrial Property Office on the Sep. 21, 1999, and there duly assigned Serial No. 99-40669.

BACKGROUND OF THE INVENTION

1. Field of the Invention

The present invention relates to an electrophotographic printing apparatus for printing an image developed on a photosensitive medium, and an image transferring method thereof, and more particularly, to an electrophotographic printing apparatus having a structure so that differences in peeling forces of components contributing to image transfer can be maintained within predetermined ranges, and an image transferring method thereof.

2. Description of the Related Art

In general, an electrophotographic printing apparatus such as a laser printer scans a laser beam on a photosensitive medium to form a latent electrostatic image, develops the latent electrostatic image using developing units, and transfers the developed image to a paper by means of a transfer unit. Electrophotographic printing apparatuses can be classified as wet type or dry type according to the developer usable in the apparatus.

Referring to FIG. 1, a general wet type electrophotographic printing apparatus includes a photosensitive medium 10 traveling along a predetermined track, laser scanning units 21 for scanning laser beams on the photosensitive medium 10 to form a latent electrostatic image, developing units 20 for developing the latent electrostatic image on the photosensitive medium 10, for toners such as black (K), cyan (C), magenta (M) and yellow (Y), a drying unit 30 for drying a carrier covered on the photosensitive medium 10, a transfer unit 40 for transferring an image (I) from the photosensitive medium 10, after having been dried by the drying unit 30, to a paper (P).

The photosensitive medium 10 includes a photosensitive belt 11 as shown in FIG. 1, or a photosensitive drum (not shown), or the like. The photosensitive belt 11 travels along a predetermined track while looped around a driving roller 13, a transfer backup roller 15, and a steering roller 17. In the vicinity of the photosensitive belt 11, an eraser 3 for irradiating the photosensitive belt 11 with light to lower electric potentials distributed on the photosensitive belt 11 to a predetermined level, and a charger 5 for charging the photosensitive belt 11 to raise the potential of the photosensitive belt 11 lowered by the eraser 3 to a predetermined potential are installed.

The drying unit 30 includes a drying roller 31 for contacting the surface of the photosensitive belt 11 on which an image (I) is formed, and absorbing carrier thereon, and a regeneration roller 33 for heating the drying roller 31 so as to evaporate a carrier absorbed by the drying roller 31. Here, if the drying roller 31 peels off even a portion of an image (I) developed on the photosensitive belt 11, the quality of the image deteriorates.

The transfer unit 40 includes a transfer roller 41 which is disposed to face the transfer backup roller 15 with the photosensitive belt 11 interposed therebetween and to which an image (I) developed on the photosensitive belt 11 is transferred, and a fuser roller 43 disposed to face the transfer roller 41 while allowing a paper (P) to pass therebetween for fixing an image transferred to the paper (P). Here, an image transferred to the transfer roller 41 is transferred to the paper (P) fed between the transfer roller 41 and the fuser roller 43.

In the wet type electrophotographic printing apparatus configured as described above, whether or not a developed image is sequentially transferred from the photosensitive belt 11 to a paper (P) is determined by differences in the surface energies of the photosensitive belt 11, the drying roller 31, the transfer roller 41, and the paper (P). That is, since toner forming an image is transferred from one member to another having a larger surface energy than the former, materials of respective members are chosen in consideration of their surface energies.

Here, the surface energy of a member functions as a factor deciding a surface adhering force $F_{surf}$ of a toner particle, the surface adhering force $F_{surf}$ being defined by the following Formulas 1 and 2.

The surface adhering force $F_{surf}$ of a toner particle is expressed as Formula 1 based on Lifshitz-van der Waals equation, as follows:

$$F_{surf} = \frac{\hbar\omega R}{8\pi z^2}, \tag{1}$$

where R is the radius of a toner particle, z is the distance between particles, and $\hbar\omega$ is the surface energy of a particle.

When the value of the distance between particles z is a constant, a proportional expression shown in Formula 2 is satisfied, as follows:

$$\frac{F_{surf}}{R} \propto \hbar\omega. \tag{2}$$

Taking the above relation into consideration, the surface energy can be converted into a value in dyne/cm. Therefore, in the following description, a value of $F_{surf}/R$ (dyne/cm) is defined and used as a surface energy.

In addition, the surface energy defined as above is an absolute value of a selected material, and the value can be used in a useful manner if it can be measured directly, but it is very difficult to directly measure the surface energy.

On the other hand, as a method of indirectly measuring the surface energy, there is a method in which after a liquid of known surface tension is dropped on an object, the contact angle of the liquid is measured. This method was proposed by Thomas Young in 1805, and the method is well-known and referred to as Young's equation.

However, when the surface energy is measured indirectly according to such a method, there can be the following problems. First, a point for measuring a contact angle must be determined, but there can be a difference of about 1° to 2° in the contact angle due to variations in the position of the measuring point. As a result, the typical deviation in a value of a surface energy is plus or minus (±) 2 dyne/cm which is generally too large a deviation. Second, since the indirect measuring method is performed on discontinuous points, measurements can be accomplished on sampled points and cannot be performed actually on the entire surface of a roller. Therefore, it is very difficult to apply this method to mass production. Third, at least two standard liquid samples for such indirect measurement are required, and it is often difficult to manage the standard samples. That is, the standard samples are kept in a controlled atmosphere at a predetermined temperature and humidity, in a unopened state.

Also, the surface energy can be determined by measuring and comparing the peeling forces (in gram force per inch (gf/inch)) of at least two components of different materials. In this regard, the peeling force is the force required to peel an adhesive tape attached to a component such as a transfer roller or a photosensitive belt, and is a relative value depending on the type of adhesive tape used for measurement, the pressing force applied during the attachment of the tape, the operation speed of the measuring apparatus, the ambient temperature, and the like.

Referring now to FIG. 2 is a perspective view of a peeling force measuring apparatus for describing a peeling force measuring method using the such apparatus. As shown in FIG. 2, the measuring apparatus 50, for example, an IMASS SP-2000 manufactured by Instrumentor Inc. includes a stage 51, and a load cell 53 for measuring a load.

After an object whose peeling force is to be measured, for example, a transfer roller 41' is installed on the measuring apparatus, an adhesive tape 55, for example, 202 Masking Tape of 3M Corp., is taped on the surface of the transfer roller 41'. Then, after the load cell 53 is connected to the adhesive tape 55, the transfer roller 41' is moved in a direction in which the load applied to the load cell 53 is increased. The peeling force is the load acting on the load cell 53 at the moment when a portion of the adhesive tape 55 is separated from the surface of the transfer roller 41' by such movement of the transfer roller 41'.

Referring now to FIG. 3, by the above-described peeling force measuring method, when peeling forces in a photosensitive belt and a transfer roller were measured in constant conditions with a large amount of sheets of paper being printed, it was found that, as shown in FIG. 3, as the number of printed sheets of paper increased, the peeling forces also increased. That is, it was found that, as illustrated in FIG. 3, in the case of the transfer roller, while the peeling force was about 100 gram force per inch (gf/inch) when the transfer roller was in a clean state, the peeling force measured after 1,000 sheets of paper were printed was about 400 gram force per inch (gf/inch). On the other hand, it was found that, in the case of the photosensitive belt, while the peeling force was about 5 gram force per inch (gf/inch) when the photosensitive belt was in a clean state, the peeling force measured after 3,000 sheets of paper were printed was about 200 gram force per inch (gf/inch).

In the case of the transfer roller, it was determined that the reason why the peeling force was increased as described above, with reference to FIG. 3, was because the surface of the transfer roller was contaminated by the material of the photosensitive belt, remaining toner, positive charges included in transferred toner, counter ions, carrier, ozone, nitric acid, the material of a dryer roller, oil particles, or the like.

As the peeling force is increased as described above, with reference to FIG. 3, there can be a problem in that, in a conventional electrophotographic printing apparatus, as illustrated in FIG. 1, for example, at least one component among the photosensitive belt 11, drying roller 31, and transfer roller 41 must be replaced, or a bad transfer of an image can occur when the total printed sheets of paper reaches a certain number. In addition, there can be a problem in that a fed paper can get wound around the transfer roller and therefore may not get discharged due to the increase of the peeling force, and a paper jam can occur. Further, there can be a problem in that when the relative relation of the photosensitive belt 11, drying roller 31, transfer roller 41, and paper (P) are not appropriately set as to peeling forces, a bad transfer of an image can occur even at the initial operation stage of a new printing apparatus.

SUMMARY OF THE INVENTION

It is an objective, among other objectives of the present invention to provide an electrophotographic printing apparatus and an image transferring method thereof adapted to decrease the probability of a bad transfer of an image by setting relations between peeling forces of a photosensitive belt, drying roller, and transfer roller.

Accordingly, to achieve the above objective and other objectives of the present invention, there is provided an electrophotographic printing apparatus including a photosensitive medium, developing units for developing respective images and forming respective films on the photosensitive medium, a drying roller for drying image films formed on the photosensitive medium by the developing units while contacting the photosensitive medium and rotating, and a transfer unit for transferring an image from the photosensitive medium to a paper while contacting the photosensitive medium and rotating, whereby, for image transfer, the peeling force of the drying roller ($PF_D$) is in a range of 0 gram force per inch (gf/inch)$\leqq PF_D \leqq$300 gram force per inch (gf/inch), the peeling force of the photosensitive medium ($PF_O$) is in a range of 0 gram force per inch (gf/inch) $\leqq PF_O \leqq$80 gram force per inch (gf/inch), and the peeling force of the transfer roller ($PF_T$) is in a range of 200 gram force per inch (gf/inch)$\leqq PF_T \leqq$500 gram force per inch (gf/inch).

In addition, in an electrophotographic printing apparatus including a photosensitive medium, laser scanning units for forming respective latent electrostatic images on the photosensitive medium, developing units for developing respective images corresponding to the latent electrostatic images on the photosensitive medium, and a transfer unit for transferring an image from the photosensitive medium to a paper by using the difference in the surface energies thereof, the apparatus further includes a peeling force adjusting means for adjusting the peeling forces of any of the photosensitive medium and the transfer unit so that the surface energy of the transfer unit can be maintained to be higher than that of the photosensitive medium.

Also, to achieve the above objective, and other objectives of the present invention, there is provided an image transferring method for electrophotographic printing apparatus, the electrophotographic printing apparatus including: a photosensitive medium; laser scanning units for forming respective latent electrostatic images on the photosensitive medium; developing units for developing respective images corresponding to the latent electrostatic images on the photosensitive medium, and for forming respective films on the photosensitive medium; a drying roller for drying image films formed on the photosensitive medium by the developing units while contacting the photosensitive medium and rotating; and a transfer unit for transferring an image from the photosensitive medium to a paper while contacting the photosensitive medium and rotating, the image transferring method including the steps of: adjusting the peeling force of the drying roller; adjusting the peeling force of the photosensitive medium; and adjusting the peeling force of the transfer roller.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 7 is a graph illustrating printed sheets versus peeling forces of the photosensitive belt and transfer roller of an electrophotographic printing apparatus according to an embodiment of the present invention; and FIGS. 8A and 8B are diagrams for comparing the quality of prints of an embodiment according the present invention (FIG. 8A) and a comparison example (FIG. 8B) when 60 lines/inch were printed in the prints at a tint of 50%.

DESCRIPTION OF THE PREFERRED EMBODIMENTS

Figure 4:
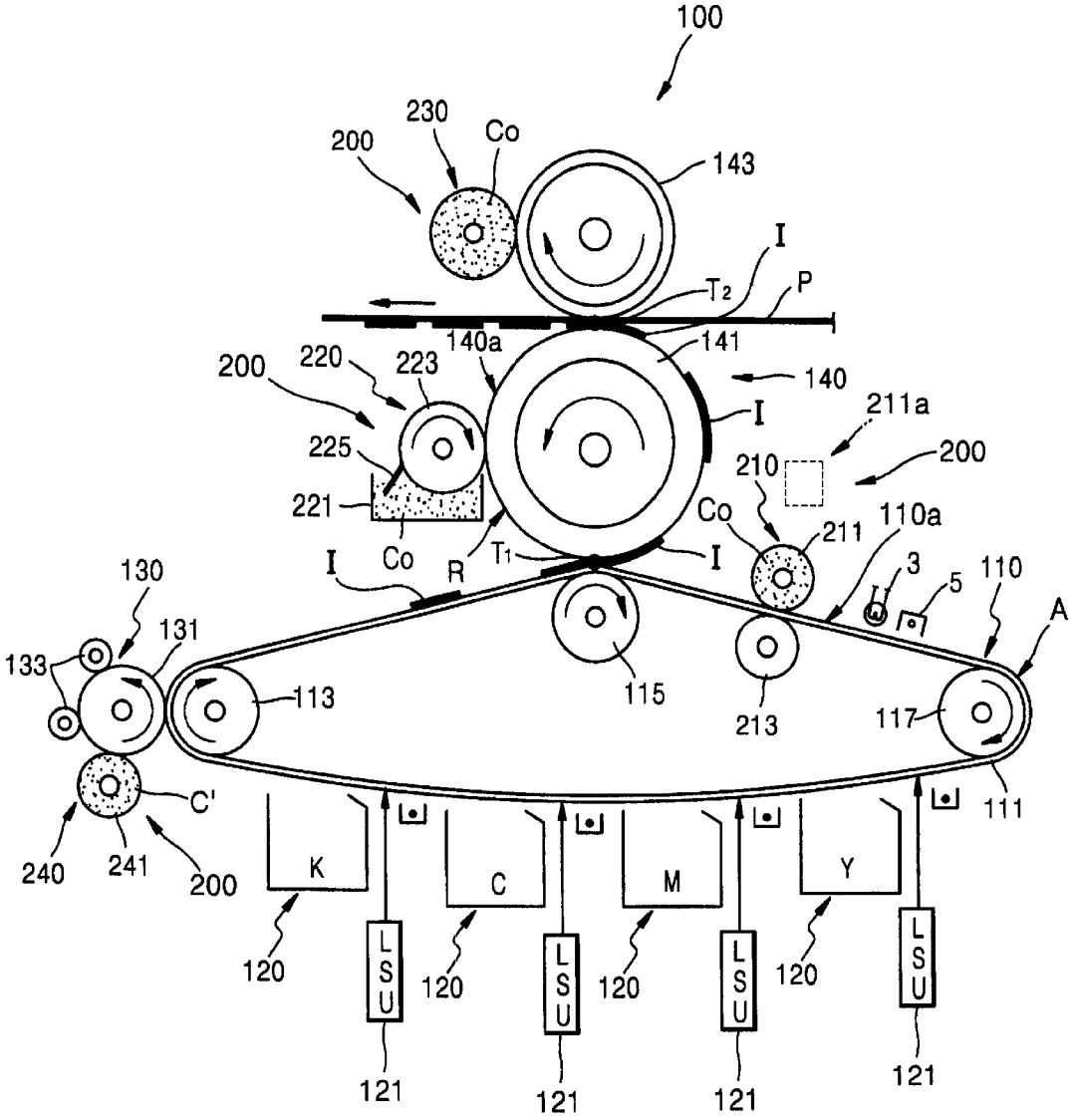
FIG. 4 is a diagram illustrating an electrophotographic printing apparatus according to an embodiment of the present invention.

Referring now to FIG. 4, FIG. 4 illustrates an electrophotographic printing apparatus 100 according to an embodiment of the present invention. The electrophotographic printing apparatus 100 includes a photosensitive medium 110 traveling along a predetermined track, laser scanning units (LSU) 121 for scanning respective laser beams on the photosensitive medium 110 to form respective latent electrostatic images, development units 120 for developing respective images corresponding to the respective latent electrostatic images, for toners such as black (K), cyan (C), magenta (M) and yellow (Y), and a transfer unit 140 for transferring an image (I) from the photosensitive medium 110 to a paper (P).

The photosensitive medium 110 includes of a photosensitive belt 111 shown in FIG. 4, or a photosensitive drum (not shown). When the photosensitive belt 111 is employed as a photosensitive medium 110, the photosensitive belt 111 loops around a driving roller 113, a transfer backup roller 115, and a steering roller 117, and circulates around a predetermined path. In the vicinity of the photosensitive belt 111, an eraser 3 is installed for irradiating the photosensitive belt 111 with light to lower electric potentials distributed on the photosensitive belt 111 to a predetermined level, and a charger 5 is installed for charging the photosensitive belt 111 to raise the potential of the photosensitive belt 111 lowered by the eraser 3 to a predetermined potential.

Continuing with reference to FIG. 4, in addition, it is preferable that in order to fit a wet type printing apparatus, the electrophotographic printing apparatus 100 further includes a drying unit 130 disposed to be rotatable while contacting the photosensitive belt 111 between the development units 120 and the transfer unit 140, for drying a carrier remaining on the photosensitive belt 111. The drying unit 130 includes of a drying roller 131 disposed to contact the surface of the photosensitive belt 111 on which an image (I) is formed for absorbing the carrier remaining on the photosensitive belt 111, and regeneration rollers 133 for heating the surface of the drying roller 131 and evaporating the carrier absorbed in the surface layer of the drying roller 131.

The transfer unit 140 of the electrophotographic printing apparatus 100 includes a transfer roller 141 disposed to face a transfer backup roller 115 with the photosensitive belt 111 interposed therebetween, the transfer roller 141 being transferred an image (I) developed on the photosensitive belt 111 at a first contact portion $T_1$ due to a difference in the surface energies thereof, and a fuser roller 143 disposed to face the transfer roller 141 with a paper (P) therebetween for fixing an image (I) onto the paper (P) at a second contact portion $T_2$.

Figure 1:
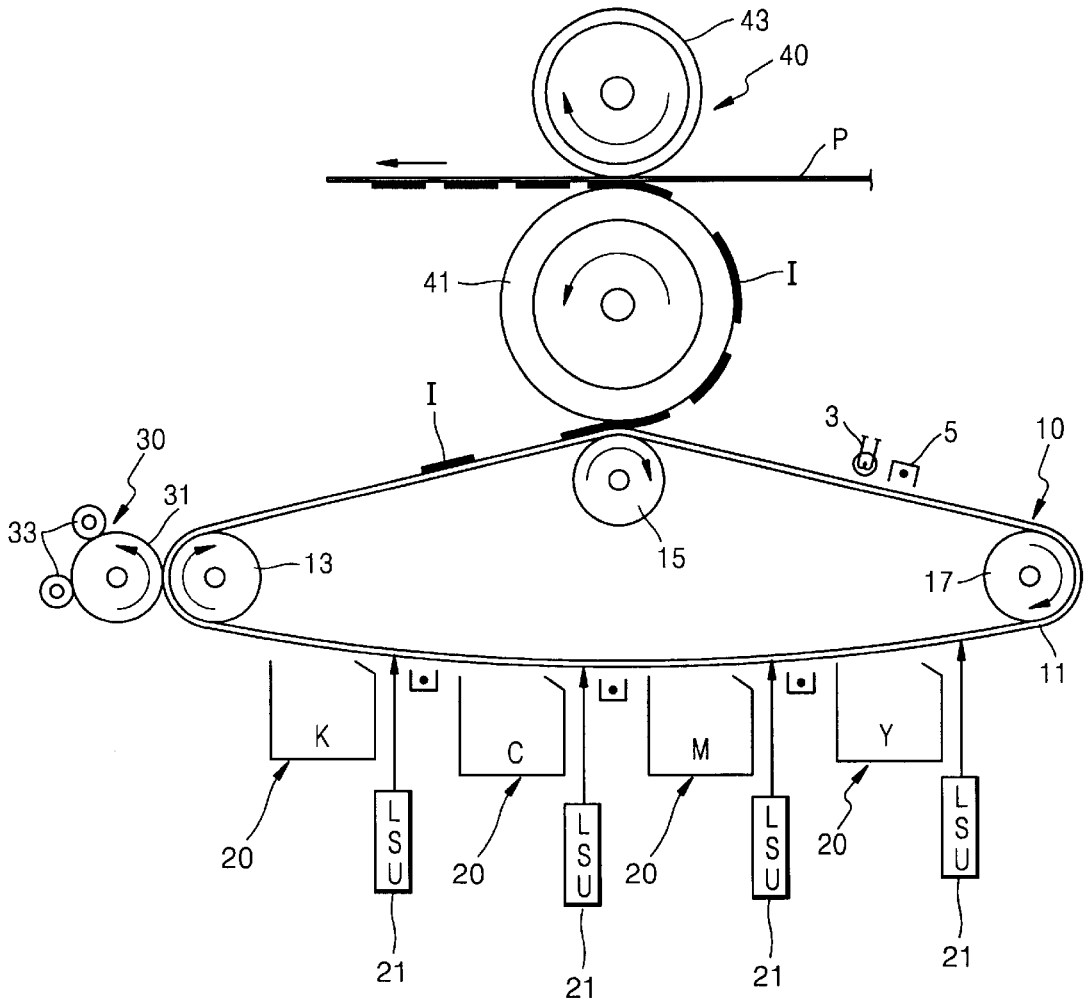
FIG.1 (PRIOR ART)
FIG. 1 is a schematic diagram illustrating a conventional electrophotographic printing apparatus.
Figure 2:
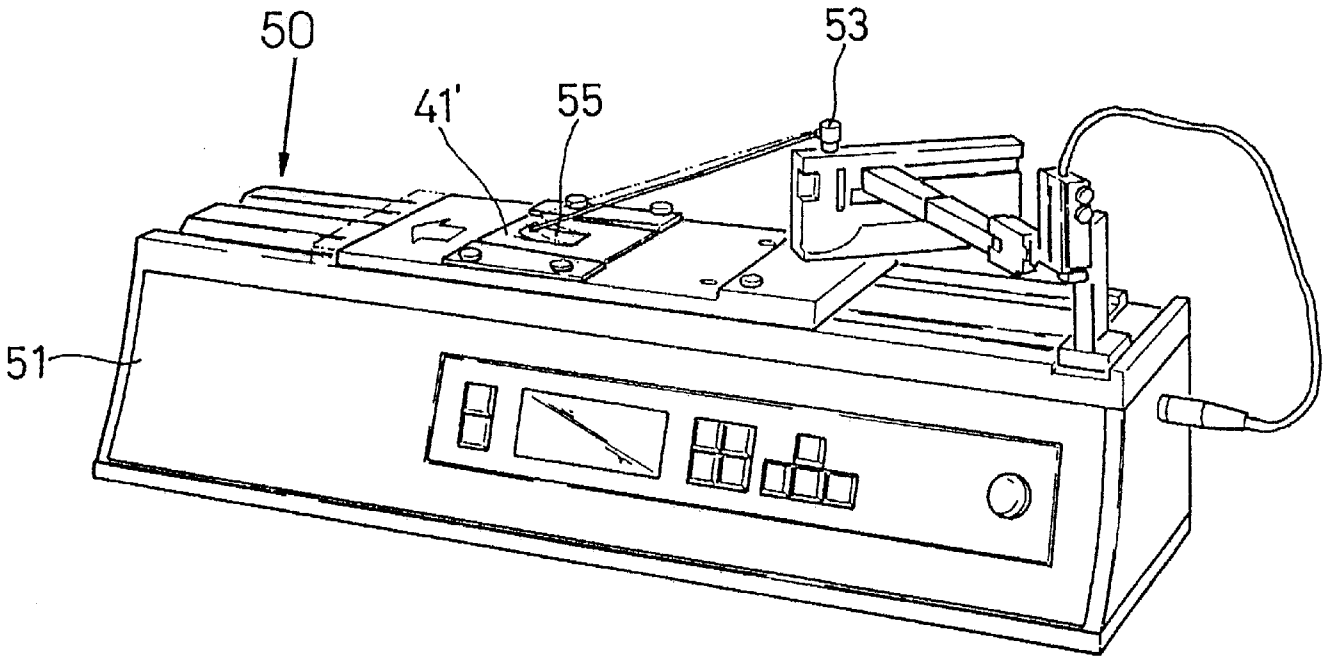
FIG.2 (PRIOR ART)
FIG. 2 is a perspective view of a peeling force measuring apparatus for describing a peeling force measuring method using the same.

To measure the respective peeling forces according to the present invention, in surrounding conditions of temperature of 25±2° C. and humidity of 65±5%, for example, the drying roller 131, photosensitive medium 110, or transfer roller 141 of the electrophotographic printing apparatus 100 of FIG. 4, whichever will be the subject of the peeling force measurement, is movably installed on a measuring apparatus, such as measuring apparatus 50 of FIG. 2, with a carrier remaining on the surface of the component removed for the electrophotographic printing apparatus 100. A 202 masking tape of 3M Corp., for example, is used as an adhesive tape, such as adhesive type 55 of FIG. 2, for measurement, one end of which is connected to the measuring apparatus, such as measuring apparatus 50 of FIG. 2, is also attached at another end to the component of the electrophotographic printing apparatus 100 on which the peeling force measurement is to be made. When the peeling force ($PF_D$) of the drying roller 131, the peeling force ($PF_O$) of the photosensitive medium 110, and the peeling force ($PF_T$) of the transfer roller 141 respectively, are measured by utilizing a force to peel the adhesive type 55, such as the 202 masking tape, from the component when the component is moved at a speed of 90 inches per minute (inch/min) with respect to the measuring apparatus, such as measuring apparatus 50, it is preferable that the peeling forces $PF_D$, $PF_O$, and $PF_T$ be in the following respective ranges to satisfy the following Formulas 3:

$$0 \text{ gflinch} \leqq PF_D \leqq 300 \text{ gflinch};$$

$$0 \text{ gflinch} \leqq PF_O \leqq 80 \text{ gflinch};$$

and $$200 \text{ gflinch} \leqq PF_T \leqq 500 \text{ gflinch}. \quad (3)$$

Also, referring to the electrophotographic image forming apparatus 100 of FIG. 4, an image transferring method according to the present invention includes the steps of: adjusting the peeling force ($PF_D$) of the drying roller 131, adjusting the peeling force ($PF_O$) of the photosensitive medium 110, and adjusting the peeling force ($PF_T$) of the transfer roller 141, whereby, for image transfer, peeling forces of the photosensitive medium 110, drying roller 131, and transfer roller 141 are respectively set to satisfy the conditions of the above-mentioned Formulas 3.

In the image transferring method of the present invention, referring again to FIG. 4, in the step of adjusting the peeling force ($PF_D$) of the drying roller 131, a predetermined coating agent is continuously or intermittently coated on the surface of the drying roller 131. Preferably, the coating agent for the drying roller 131 is a silicone wax. In addition, in the step of adjusting the peeling force ($PF_O$) of the photosensitive medium 110 a predetermined coating agent is continuously or intermittently coated on the surface of the photosensitive medium 110, and it is preferable that the coating agent for the photosensitive medium 110 is a polydimethyl siloxane or a cyclic silicone. Also, the step of adjusting the peeling force ($PF_T$) of the transfer roller 141 a predetermined coating agent is continuously or intermittently coated on the surface of the transfer roller 141, and it is preferable that the coating agent for the transfer roller 141 is a silicone wax.

Figure 5:
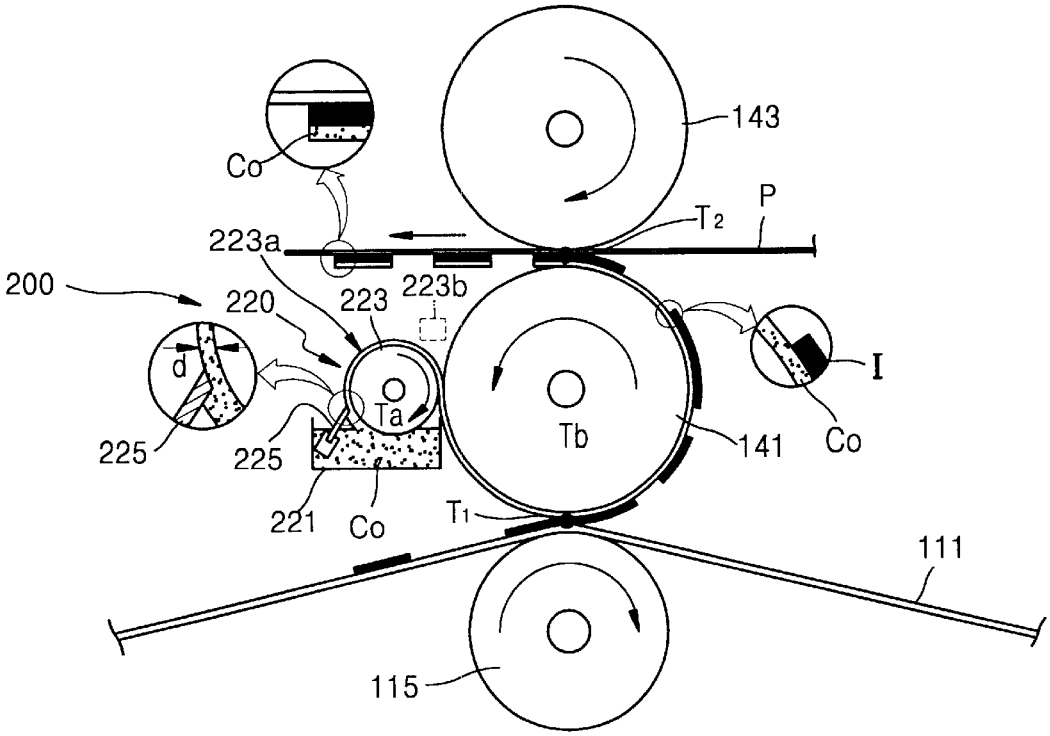
FIG. 5 is a diagram illustrating a coating station of a transfer roller of FIG. 4.
Figure 6:
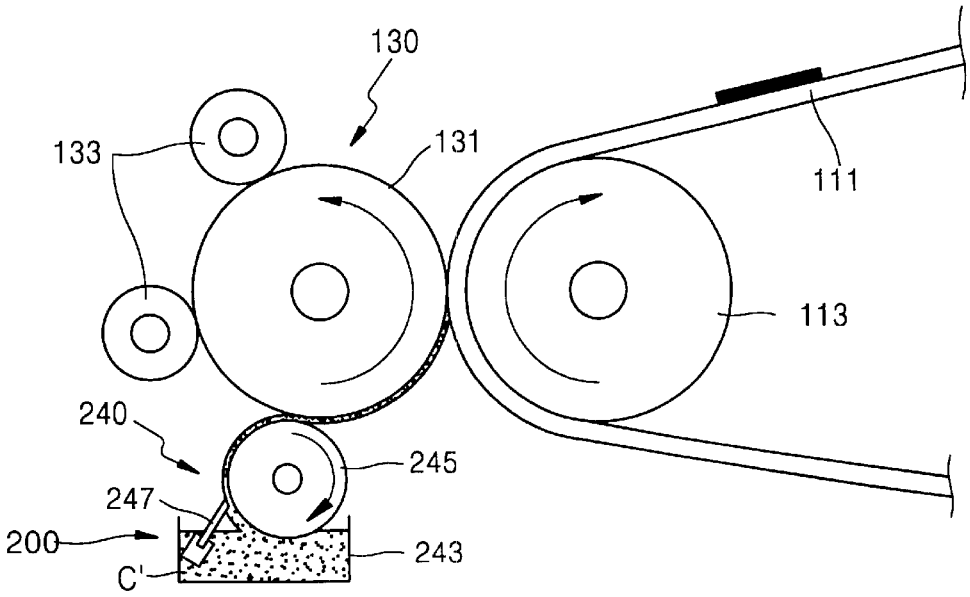
FIG. 6 is a schematic diagram illustrating a coating station of a drying roller of FIG. 4.

In addition, referring to FIGS. 4 through 6, it is preferable that the electrophotographic printing apparatus, such as electrophotographic printing apparatus 100, and image forming method of the present invention further includes a peeling force adjusting means 200 for adjusting a peeling force so that the surface energy of the transfer unit 140 can be maintained to be higher than the surface energy of the photosensitive medium 110. In the electrophotographic printing apparatus according to the present invention, such as electrophotographic printing apparatus 100, the peeling force adjusting means 200 is a means for coating respective components so that even when the number of printed papers (P) becomes larger, differences between the surface energies of the photosensitive medium 110, drying roller 131, transfer roller 141, and paper (P) can satisfy the conditions or ranges of the above-mentioned Formulas 3 for $PF_D$, $PF_O$, and $PF_T$.

The peeling force adjusting means 200 is installed in the electrophotographic printing apparatus 100 to be capable of contacting either or both of the photosensitive medium 110 and the transfer unit 140, and can include a photosensitive medium coating station 210 for coating the image surface 111*a* of the photosensitive medium 110, and can include a transfer unit coating station 220 for coating the transfer surface 140*a* of the transfer unit 140.

The photosensitive medium coating station 210 is installed to be rotatable while contacting the photosensitive medium 110, and includes a coating roller 211 containing a coating agent therein. In the case that the photosensitive medium coating station 210 intermittently contacts the photosensitive medium 110, the photosensitive medium coating station 210 is installed to be moved by a predetermined driving means 211*a*. Such a predetermined driving means 211*a* is a conventional driving means for producing an alternating motion between a contact position where the coating roller 211 contacts the photosensitive medium 110 and a non-contact position where the coating roller 211 does not contact the photosensitive medium 110, such as belt 111. An example of a predetermined driving means 211*a* is a cylinder mechanism for reciprocating movement between a contact and a non-contact position for coating roller 211.

Preferably, the photosensitive medium coating station 210 is disposed on the circulation path A of the photosensitive medium 110 in an area from the transfer unit 140 to the development unit 120, so as to coat the image surface 110*a* of the photosensitive medium 110 which is not developed.

It is preferable that the coating agent contained within the coating roller 211 includes a polydimethyl siloxane or a cyclic silicone, such as made by Dow Corning Corp. When the photosensitive belt 111 is employed as the photosensitive medium 110, it is preferable that a coating backup roller 213 is provided so that the coating roller 211 can contact the photosensitive belt 111 at a predetermined stroke.

Figure 3:
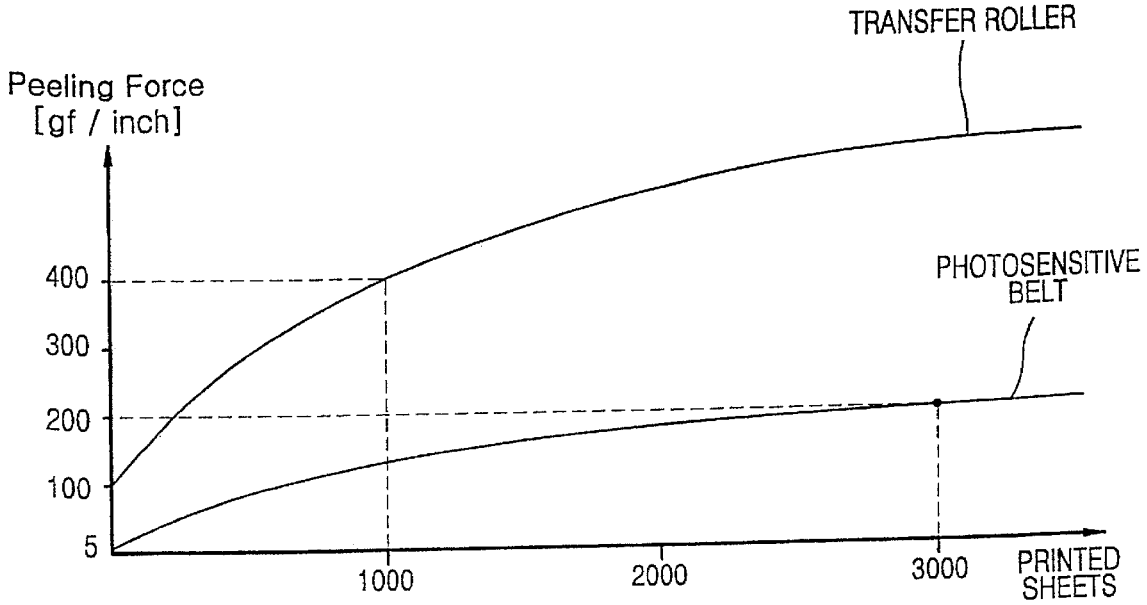
FIG.3 (PRIOR ART)
FIG. 3 is a graph illustrating printed sheets versus peeling forces of a photosensitive belt employed as a photosensitive medium and a transfer roller.

As a result of measuring the peeling force ($PF_O$) of the photosensitive belt 111 of the electrophotographic printing apparatus 100 by using the peeling force measuring apparatus 50 shown in FIG. 2, a difference in the peeling force $PF_O$ was evident depending on whether the coating agent was coated on the photosensitive belt 111. When the peeling force ($PF_O$) of the photosensitive belt 111 was measured a plurality of times after about one thousand (1,000) papers (P) were printed, the measured peeling forces $PF_O$ were in the range of about 70 to 150 gram force per inch (gf/inch) when the coating agent was not used. On the other hand, when a polydimethyl siloxane coating agent having a viscosity of 50 centipoise was coated on the photosensitive belt 111, it was found that the peeling force $PF_O$ decreased to the range of about 5 to 20 gram force per inch (gf/inch). When the results of the measurements are compared to the graph shown in FIG. 3, in the case that the coating agent is coated on the photosensitive belt 111, the value of the peeling force ($PF_O$) of the photosensitive belt 111 after printing 1,000 sheets of paper is advantageously about the same as the peeling force ($PF_O$) of a photosensitive belt 111 which has performed almost no printing.

Referring now to FIG. 5, the transfer unit coating station 220 of the peeling force adjusting means 200 includes a container 221 containing a coating agent, a coating roller 223 installed in the container 221 to be rotatable and to contact the transfer roller 141, and a blade 225 one end of which is disposed to be spaced a predetermined distance d from the outer circumference of the coating roller 223, for regulating the thickness of the coating agent (Co) coated on the surface 223*a* of the coating roller 223. In the case that the transfer unit coating station 220 intermittently contacts the transfer roller 141, the transfer unit coating station 220 is installed to be moved by a predetermined driving means 223*b* similar to the predetermined driving means 211*a*, such as a cylindrical mechanism for reciprocating movement between a contact and a non-contact position for coating roller 223. It is preferable that the coating agent (Co) for coating the transfer surface 140*a* of transfer roller 141 of transfer unit 140 is a silicone wax, for example, GP-533 or EXP-58, both products of Genesee Corp. Also, on the other hand, the transfer unit coating station 220 can be constructed to have to a coating roller structure containing a coating agent Co therein, as in the above-described photosensitive medium coating station 210 having coating roller 211 including therein a coating agent (Co).

In addition, it is preferable that the transfer unit coating station 220 is installed on the rotation path R between the second contact portion $T_2$ of the transfer roller 141 with a paper (P) and the first contact portion $T_1$ of the transfer roller 141 with photosensitive belt 111 so as to contact the transfer roller 141, so that the coating agent (Co) for coating the transfer surface 140*a* the transfer roller 141 can protect an image (I) printed on a paper (P).

Further, continuing with reference to FIGS. 4 through 6, the peeling force adjusting means 200 further includes a fuser roller coating station 230 (FIG. 4) installed to contact the fuser roller 143 for applying a coating agent (Co) to the outer circumferential surface of the fuser roller 143. This can prevent the back surface of a paper (P) from being contaminated, and can also prevent the paper (P) from being rolled around the fuser roller 143. In addition, when both surfaces of a paper (P) are used in printing, image picking can be prevented. Here, the coating agent (Co) of the fuser roller coating station 230 can be a silicone wax or a dry type lubricant containing a fluoride, for example.

Thus, since the transfer unit 140 is provided with the transfer unit coating station 220, it was found that there were the following differences depending on whether the coating agent was coated on the transfer roller 141. As a comparison, for example, when the peeling force of the transfer roller 141 was measured a plurality of times by using the measuring apparatus shown in FIG. 2, after about one thousand (1,000) papers (P) were printed, the measured peeling forces were in the range of about 400 to 450 gram force per inch (gf/inch) when the coating agent was not used. On the other hand, when a silicone wax, such as GP-533, was coated on the transfer roller 141, it was found that the peeling force decreased to about 300 gram force per inch (gf/inch). In addition, durability characteristics of an image printed on a paper (P), for example, such as blocking and image damage characteristics, can be improved by using the coating agent.

Continuing, in addition, when a silicone wax, such as GP-533, was coated on the fuser roller 143, contamination of the surface of the fuser roller 143 appeared after only 30 papers were printed. On the other hand, when a dry-type lubricant, such as F1-777, for example, was coated on the fuser roller 143, contamination of the surface of the fuser roller 143 did not appear until 500 papers were printed.

In addition, continuing with reference to FIG. 4 through 6, it is preferable that the peeling force adjusting means 200 further includes a drying unit coating station 240 installed to contact the drying unit 130 for continuously or intermittently coating the surface of the drying unit 130 which contacts the photosensitive medium 110.

As shown in FIG. 4, the drying unit coating station 240 is installed to be rotatable and to contact the drying unit 130, and can include a coating roller 241 which contains a coating agent (C'), such as a silicone wax or the like, for example, therein.

In addition, referring to FIG. 6, the drying unit coating station 240 can include a container 243 which contains a coating agent (C'), a coating roller 245 installed in the container 243 to be rotatable and to contact the drying unit 130, and a blade 247, one end of which is disposed to be spaced a predetermined distance from the outer circumference of the coating roller 245 for regulating the thickness of the coating agent (C') coated on the surface of the coating roller 245. The coating agent (C') for coating the drying roller 131 is composed of a silicone wax, or the like, for example.

Thus, since the drying unit 130 is provided with the drying unit coating station 240, it was found that there was the following difference depending on whether the coating agent was coated on the drying roller 131. As a comparison, for example, when the peeling force of the drying roller 131 was measured a plurality of times by using the measuring apparatus shown in FIG. 2, the measured peeling forces were in the range of about 70 to 150 gram force per inch (gf/inch) when the coating agent was not used. On the other hand, when silicone wax, such as GP-533, was coated on the drying roller 141, it was found that the peeling force decreased to about 10 gram force per inch (gf/inch).

FIG. 7 is a graph illustrating printed sheets (P) versus peeling forces of the above-described photosensitive belt 111 and transfer roller 141 in the electrophotographic printing apparatus 100 when respective coating agents were intermittently coated on the photosensitive belt 111 and transfer roller 141. As can be seen in the graph, the peeling forces of the photosensitive belt 111 and transfer roller 141 can be maintained within a predetermined range by intermittently coating the respective coating agents on the photosensitive belt 111 and transfer roller 141 even when the number of printed papers (P) increases. As a matter of fact, when coating agents for controlling peeling forces are continuously coated on respective components of the above described electrophotographic printing apparatus 100, for example, an increase in peeling forces due to contamination of the surfaces of the respective components, occurring when the number of printed sheets (P) increases, can be prevented.

As described above, since in the electrophotographic printing apparatus of the present instruction, such as electrophotographic printing apparatus 100, the relationships between the peeling forces of any of the photosensitive medium, transfer unit, and the drying unit are set, and the electrophotographic printing apparatus is provided with the peeling force adjusting means, the peeling forces can be advantageously maintained within respective predetermined ranges.

FIGS. 8A and 8B are diagrams for comparing the quality of prints of an embodiment according the present invention, as illustrated in FIG. 8A, and a comparison example as illustrated in in FIG. 8B, when 60 lines/inch were printed at a tint of 50%. While image picking is severely exhibited in the comparison example of FIG. 8B, as can be seen in the portion indicated by D of the comparison example of FIG. 8B, almost no image picking is exhibited in the embodiment according to the present invention, as illustrated in FIG. 8A.

In addition, in the present invention, the efficiency of image transfer is improved at the first contact portion $T_1$ between the transfer roller and the photographic medium, such as a photosensitive belt, and the second contact portion $T_2$, where the fuser roller faces the transfer roller for receiving a paper (P) therebetween, for fixing an image on the paper (P), and the possibility of a paper jam which can occur when a paper is rolled around any of the transfer roller and fuser roller can be reduced markedly.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An electrophotographic printing apparatus, comprising:

a photosensitive medium;

a developing unit for developing each respective image and for forming each respective film on the photosensitive medium;

a drying roller for drying each image film formed on the photosensitive medium by the developing unit; and a transfer unit having a transfer roller for transferring each formed image from the photosensitive medium respectively to a paper and whereby, for image transfer, a peeling force of the drying roller ($PF_D$) is in a range of 0 gram force per inch (gf/inch)$\leqq PF_D \leqq$300 gram force per inch (gf/inch), a peeling force of the photosensitive medium ($PF_O$) is in a range of 0 gram force per inch (gf/inch)$\leqq PF_O \leqq$80 gram force per inch (gf/inch), and a peeling force of the transfer roller ($PF_T$) is in a range of 200 gram force per inch (gf/inch)$\leqq PF_T \leqq$500 gram force per inch (gf/inch).

2. The electrophotographic printing apparatus as claimed in claim 1, further comprising a measuring apparatus for respectively measuring the peeling force ($PF_D$) of the drying roller, the peeling force ($PF_O$) of the photosensitive medium and the peeling force ($PF_T$) of the transfer roller, the measuring apparatus utilizing a force required to peel an adhesive tape for measurement from the corresponding one of drying roller, the photosensitive medium and the transfer roller, when the corresponding one of the drying roller, the photosensitive medium and the transfer roller are movably installed on the measuring apparatus with one end of the adhesive tape for measurement attached to the installed corresponding one of the drying roller, the photosensitive medium and the transfer roller, and the other end of the adhesive tape for measurement being respectively connected to the measuring apparatus.

3. The electrophotographic printing apparatus as claimed in claim 2, further comprised of, for measurement of a corresponding peeling force of a corresponding one of the drying roller, the photosensitive medium, and the transfer roller, the corresponding one of the drying roller, the photosensitive medium, and the transfer roller being moved at a speed of 90 inch/min with respect to the measuring apparatus at a temperature in a range of from 23° C. to 27° C. and at a humidity in a range of from 60% to 70%.

4. The electrophotographic printing apparatus as claimed in claim 3, further comprised of a carrier for the image transfer being on a respective surface of the corresponding one of the drying roller, the photosensitive medium, and the transfer roller during measurement of the corresponding peeling force by the measuring apparatus.

5. The electrophotographic printing apparatus as claimed in claim 2, further comprised of a carrier for the image transfer being on a respective surface of the corresponding one of the drying roller, the photosensitive medium, and the transfer roller during measurement of a corresponding peeling force by the measuring apparatus.

6. The electrophotographic printing apparatus as claimed in claim 1, further comprising a peeling force adjusting means for adjusting any one of the peeling force of the photosensitive medium ($PF_O$) and the peeling force of the transfer roller ($PF_T$) so that a surface energy of the transfer roller is higher than a surface energy of the photosensitive medium.

7. An electrophotographic printing apparatus, comprising:

a photosensitive medium;

a laser scanning unit for forming each respective latent electrostatic image on the photosensitive medium;

a developing unit for developing each respective image corresponding to a latent electrostatic image formed on the photosensitive medium;

a transfer unit for transferring each formed image from the photosensitive medium to a paper by using a difference in surface energy between the photosensitive medium and the transfer unit; and a peeling force adjusting means for adjusting a peeling force of any one of the photosensitive medium and the transfer unit so that a surface energy of the transfer unit is higher than a surface energy of the photosensitive medium.

8. The electrophotographic printing apparatus as claimed in claim 7, further comprised of the peeling force adjusting means including a coating station selectively contacting the photosensitive medium for coating an image surface of the photosensitive medium with a coating agent, and a coating station for selectively contacting the transfer unit for coating a transfer surface of the transfer unit with a coating agent.

9. The electrophotographic printing apparatus as claimed in claim 8, further comprised of the coating station for the photosensitive medium and the coating station for the transfer unit comprises:

a container for containing a coating agent;

a coating roller installed in the container for rotatable movement so as to contact a corresponding one of the photosensitive medium and transfer unit; and a blade, one end of the blade being disposed to be spaced a predetermined distance from an outer circumference of the coating roller for regulating a thickness of the coating agent coated on a surface of the coating roller.

10. The electrophotographic printing apparatus as claimed in claim 8, further comprised of any of the coating station for the photosensitive medium and the coating station for the transfer unit comprises a coating roller containing a coating agent, the coating roller being rotatively installed to selectively contact a corresponding one of the photosensitive medium and the transfer unit.

11. The electrophotographic printing apparatus as claimed in claim 8, further comprised of the transfer unit comprising:

a transfer roller for contacting the photosensitive medium and for transferring at a first contact portion a developed image on the photosensitive medium due to a difference in a surface energy of the transfer roller and the surface energy of the photosensitive medium; and a fuser roller disposed to face the transfer roller for receiving therebetween a paper and for fixing at a second contact portion an image transferred to the paper; and the coating station for the transfer unit being installed on a rotation path between the second contact portion and the first contact portion for coating the transfer roller with a coating agent.

12. The electrophotographic printing apparatus as claimed in claim 11, further comprised of the peeling force adjusting means further comprising a fuser roller coating station installed for contacting the fuser roller for applying a coating agent to an outer circumferential surface of the fuser roller.

13. The electrophotographic printing apparatus as claimed in claim 8, further comprising a drying unit disposed between the developing unit and the transfer unit for rotatively contacting the photosensitive medium for drying a carrier when remaining on the photosensitive medium, and the peeling force adjusting means further comprising a drying unit coating station for selectively contacting the drying unit for coating a coating agent on a surface of the drying unit which contacts the photosensitive medium.

14. The electrophotographic printing apparatus as claimed in claim 13, further comprised of the drying unit coating station comprising:

a container for containing a coating agent;

a coating roller installed in the container for rotatable movement for contacting the drying unit; and a blade, one end of the blade being disposed to be spaced a predetermined distance from an outer circumference of the coating roller for regulating a thickness of the coating agent coated on a surface of the coating roller.

15. The electrophotographic printing apparatus as claimed in claim 13, further comprised of the drying unit coating station comprising a coating roller containing the coating agent and being rotatively installed for contacting the drying unit.

16. An image transferring method for an electrophotographic printing apparatus, comprising the steps of:

providing a photosensitive medium;

providing a laser scanning unit for forming each respective latent electrostatic image on the photosensitive medium;

providing a developing unit for developing each respective image corresponding to a latent electrostatic image on the photosensitive medium and for forming each respective film on the photosensitive medium;

providing a drying roller for drying each image film formed on the photosensitive medium by the developing unit;

providing a transfer unit having a transfer roller for transferring each image transferred from the photosensitive medium to a paper;

adjusting the peeling force ($PF_D$) of the drying roller to be in a range of 0 gram force per inch (gf/inch) $\leqq PF_D \leqq 300$ gram force per inch (gf/inch);

adjusting the peeling force ($PF_O$) of the photosensitive medium to be in a range of 0 gram force per inch (gf/inch) $\leqq PF_O \leqq 80$ gram force per inch (gf/inch); and adjusting the peeling force ($PF_T$) of the transfer roller to be in a range of 200 gram force per inch (gf/inch) $\leqq PF_T 500$ gram force per inch (gf/inch).

17. The image transferring method for an electrophotographic printing apparatus as claimed in claim 16, further comprised of the step of adjusting the peeling force ($PF_D$) of the drying roller comprising coating a predetermined coating agent on a surface of the drying roller.

18. The image transferring method for an electrophotographic printing apparatus as claimed in claim 17, further comprised of the coating agent for the drying roller being a silicone wax.

19. The image transferring method for an electrophotographic printing apparatus as claimed in claim 16, further comprised of the step of adjusting the peeling force ($PF_O$) of the photosensitive medium, further comprising coating a predetermined coating agent on a surface of the photosensitive medium.

20. The image transferring method for an electrophotographic printing apparatus as claimed in claim 16, further comprised of the step of adjusting the peeling force ($PF_T$) of the transfer roller further comprising coating a predetermined coating agent on a surface of the transfer roller.

21. The image transferring method for an electrophotographic printing apparatus as claimed in claim 16, further comprised of: the step of adjusting the peeling force ($PF_T$) of the transfer roller further comprising coating a predetermined coating agent on a surface of the transfer roller, the step of adjusting the peeling force ($PF_D$) of the drying roller further comprising coating a predetermined coating agent on a surface of the drying roller, and the step of adjusting the peeling force ($PF_O$) of the photosensitive medium further comprising coating a predetermined coating agent on a surface of the photosensitive medium.

* * * * *